US007566018B1

(12) United States Patent
Brown et al.

(10) Patent No.: US 7,566,018 B1
(45) Date of Patent: Jul. 28, 2009

(54) ROCK CRUSHER COUNTERWEIGHT OIL DEFLECTION PLATES

(75) Inventors: Andrew Brown, Perth, WA (US); Kurt O'Bryan, Wales, WI (US)

(73) Assignee: FL Smidth A/S, Valby (DK)

( * ) Notice: Subject to any disclaimer, the term of this patent is extended or adjusted under 35 U.S.C. 154(b) by 0 days.

(21) Appl. No.: 12/290,968

(22) Filed: Nov. 4, 2008

(51) Int. Cl.
*B02C 15/10* (2006.01)
*B02C 17/08* (2006.01)

(52) U.S. Cl. ..... 241/207; 241/215

(58) Field of Classification Search ..... 241/207, 241/208, 215
See application file for complete search history.

(56) References Cited

U.S. PATENT DOCUMENTS 4,750,681 A * 6/1988 Sawant et al. ..... 241/208
5,971,306 A * 10/1999 Ganser et al. ..... 241/207
5,996,916 A * 12/1999 Musil ..... 241/215
7,048,214 B2 * 5/2006 Johnson et al. ..... 241/65

* cited by examiner

*Primary Examiner*—Bena Miller
(74) *Attorney, Agent, or Firm*—Aaron M. Pile; Daniel De Joseph

(57) ABSTRACT

A conical rock crusher, such as a conical cone or gyratory crusher incorporating at least one oil deflection plate serving to redirect oil from exiting the crusher thereby to reducing oil loss.

13 Claims, 3 Drawing Sheets

ROCK CRUSHER COUNTERWEIGHT OIL DEFLECTION PLATES

BACKGROUND OF THE INVENTION

The present invention relates generally to a conical rock crusher. More specifically, the present invention relates to a conical rock crusher, such as a conical cone or gyratory crusher, having a component to redirect oil from exiting the crusher thereby reducing oil loss.

Cone crushers generally include an eccentric assembly that rotates about a main shaft and imparts gyratory motion to a head assembly. Material to be crushed is loaded into a feed hopper that feeds into a bowl assembly. The material, generally rock, is crushed between a bowl liner disposed in the bowl assembly and a mantle on the crusher head assembly.

To crush rock between the head assembly and the bowl assembly, gyratory motion is imparted to the head assembly to alternately widen and narrow the gap between the head assembly and bowl assembly. The gyratory motion may be imparted via an eccentric that rotates with respect to a stationary shaft and directly imparts the eccentric motion to the head assembly. Alternatively, an eccentric assembly may be used to impart gyratory motion to a movable shaft, which in turn imparts gyratory motion to the head assembly. In either case, a frame supports the shaft and head assembly, and a countershaft or other driving mechanism is utilized to drive the eccentric assembly. These assemblies are continuously lubricated by a pumped lubrication system to prevent seizing of the rotating parts. The lubrication is retained within the assemblies by a system of seals located where each assembly is connected to the other.

Such cone crushers, especially such crushers that are large in size, have counterweights incorporated into their design that rotate in unison with the eccentric assembly. The shape of the counterweight is specifically designed to compensate for the mass eccentricity of the eccentric and head assembly so that the assembly of eccentric, counterweight and head assembly is balanced to produce no net horizontal forces on the foundation. This design of the counterweight results in one side of the counterweight (the side the eccentric does not favor) being thick and solid (the "heavy side") while the other, "light", side of the counterweight (the side the eccentric favors) having a thinner upper portion and a lower portion from which a floor extends in the direction of the eccentric. The floor has holes (also know as kidneys) on its upper side that may, but do not necessarily, extend through the thickness of the floor. The differing thicknesses in the sides of the counterweight also result in "transition ledges" in the area where the counterweight transitions from its heavy side to its light side.

During normal operation of the rock crusher, the counterweight rotates along with the eccentric and head assembly. It has been observed that this rotation results in substantial loss of lubricant through the seal systems and head assembly. It is one object of the present invention to reduce the loss of lubricant in a rock crusher.

SUMMARY OF THE INVENTION

One of the problems with existing eccentric cone crushers is substantial loss of lubricating oil during no-load and normal operation through the seal systems and head assembly. The gyration of the head assembly, eccentric and counterweight during crusher operation causes lubricating oil to travel across the floor of the counterweight due to centrifugal force. Upon hitting the sides of the counterweight, some of the lubricating oil is redirected upward and/or redirected off the transition ledges. This redirected lubricating oil is then able to escape the lubrication system through the seal systems and head assembly, both of which are generally located above the counterweight.

To overcome this problem associated with existing cone crushers and to achieve the above and other objectives, the present invention provides a cone crusher with one or more oil deflection plates incorporated into the structure of the counterweight, which redirect the lubrication oil away from the seal systems and head assembly thereby significantly reducing the amount of lubricating oil that is able to escape therefrom.

There are many methods of incorporating the oil deflection plates into the structure of the counterweight. For example, the oil deflection plates are attached such as by welding or bolting them to the structure or are cast as an integral part of the structure or can be attached or integrated in any other manner known to one skilled in the art.

In one embodiment, the invention provides a cone crusher and counterweight having at least one oil deflection plate covering the transition ledge(s).

In another embodiment, the invention provides a cone crusher and counterweight having at least one oil deflection plate covering the kidney(s).

In a preferred embodiment, the invention provides a cone crusher and counterweight having a separate oil deflection plate dimensioned so as to substantially cover each kidney. With regard to the transition ledges, they can be covered by a separate plate or a deflection plate that also covers a kidney. In each instance, the oil deflection plate will extend from the counterweight and overhang the transition ledge or kidney, as the case may be. Preferably, the oil deflection plate will substantially cover the transition ledge or kidney. If the deflection plate extends out substantially farther than the kidney it can serve to hinder the flow of lubricating oil from upper areas of the eccentric to the lower eccentric assembly.

One advantage of the present invention is that by having oil deflection plates overhanging and covering each of the transition ledge(s) and/or kidney(s) significantly reduces the amount of lubrication oil that escapes the lubrication system of the crusher. Thus, the amount of lubricating oil needed to operate the crusher is greatly reduced, providing substantial savings to an owner or operator of a crusher.

Another advantage of the present invention is that the oil deflection plates are easily incorporated into a new crusher. In addition, such plates can be easily retrofitted for existing crushers thereby reducing lubrication oil consumption on existing crushers as well.

Other features and advantages of the invention will become apparent to those skilled in the art upon review of the following detailed description, claims and drawings.

DETAILED DESCRIPTION OF THE INVENTION

Figure 1:
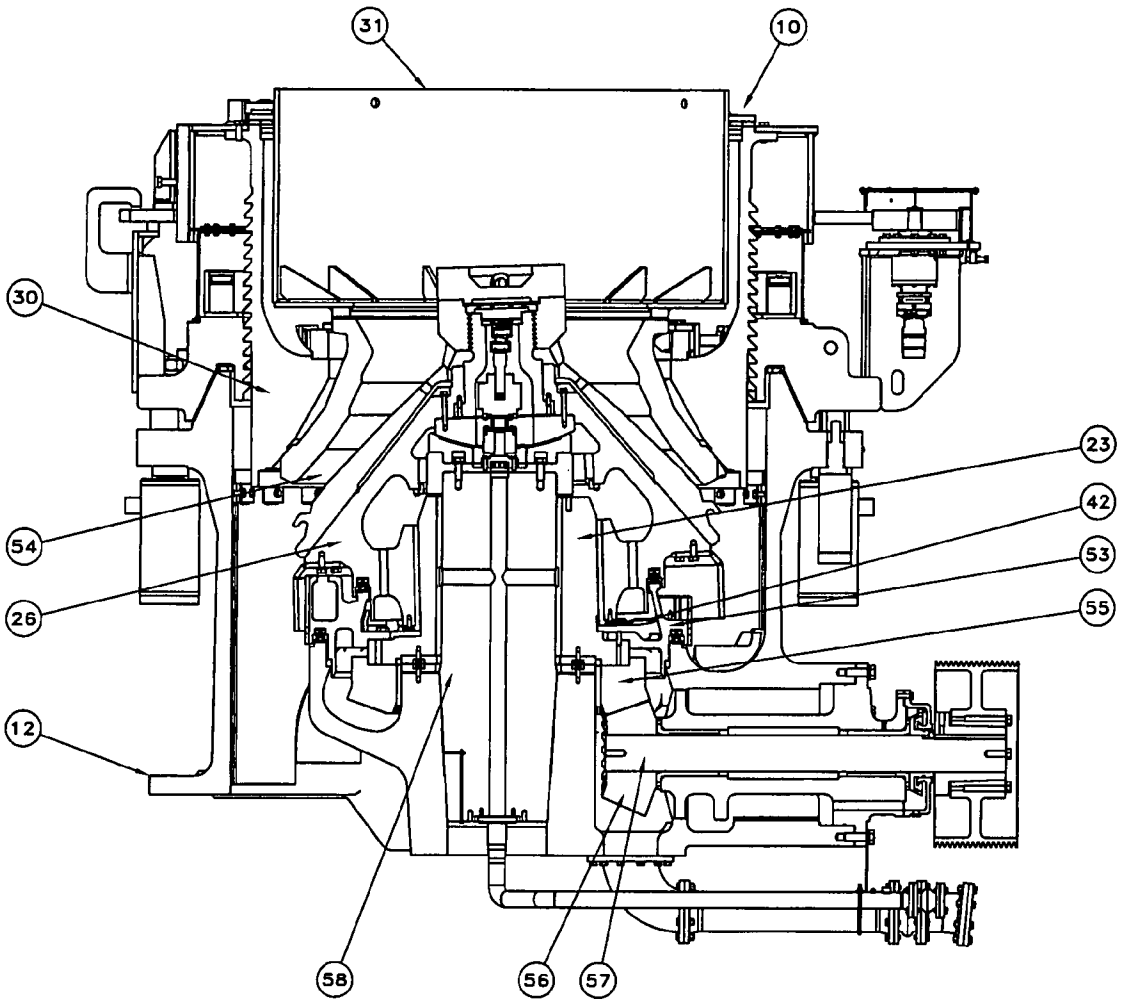
FIG. 1 is a cross-sectional view of a cone crusher embodying the present invention.

FIG. 1 is a cross section view of a cone crusher embodying the present invention. It should be understood that except for the deflection plates 42, the crusher, including the counterweight 53, is constructed and operates similarly to prior art cone crushers. The basic structure of the crusher 10 includes a frame 12, a bowl 30 that is attached to the frame 12, and head assembly 26 which is located on the axis of bowl 30. Head assembly 26 is shaped as a cone and has its larger diameter at the lower end of bowl 30 so that together bowl 30 and head assembly 26 form crushing volume 54 which is larger at the top and smaller at the lower end. This configuration permits larger material to be fed into a hopper 31 at the top of the crusher 10, that as the material falls toward the bottom of bowl 30 it is crushed into smaller pieces which subsequently exit crusher 10.

Head assembly 26 is driven by an eccentric assembly 23 which is rotated by an attached gear 55 which is conventionally driven through a pinion 56 attached to a countershaft 57. Eccentric assembly 23 imparts to head assembly 26 an eccentric motion, essentially a gyration, for crusher 10 to function. Eccentric assembly 23 has an eccentric center volume and is generally cylindrical. A fixed mainshaft 58 fits into and is attached to the main frame 12. Eccentric assembly 23 rotates about the mainshaft 58 and, as the eccentric assembly 23 rotates, its eccentric center volume moves the head assembly 26 in an eccentric path imparting the gyratory motion.

The eccentric assembly 23 is encircled by a counterweight 53. The counterweight 53 is specifically designed to compensate for the mass eccentricity of the eccentric 23 and head assembly 26 so that the assembly of eccentric 23, counterweight 53 and head assembly 26 is balanced to produce no net horizontal forces on the foundation.

Figure 2:
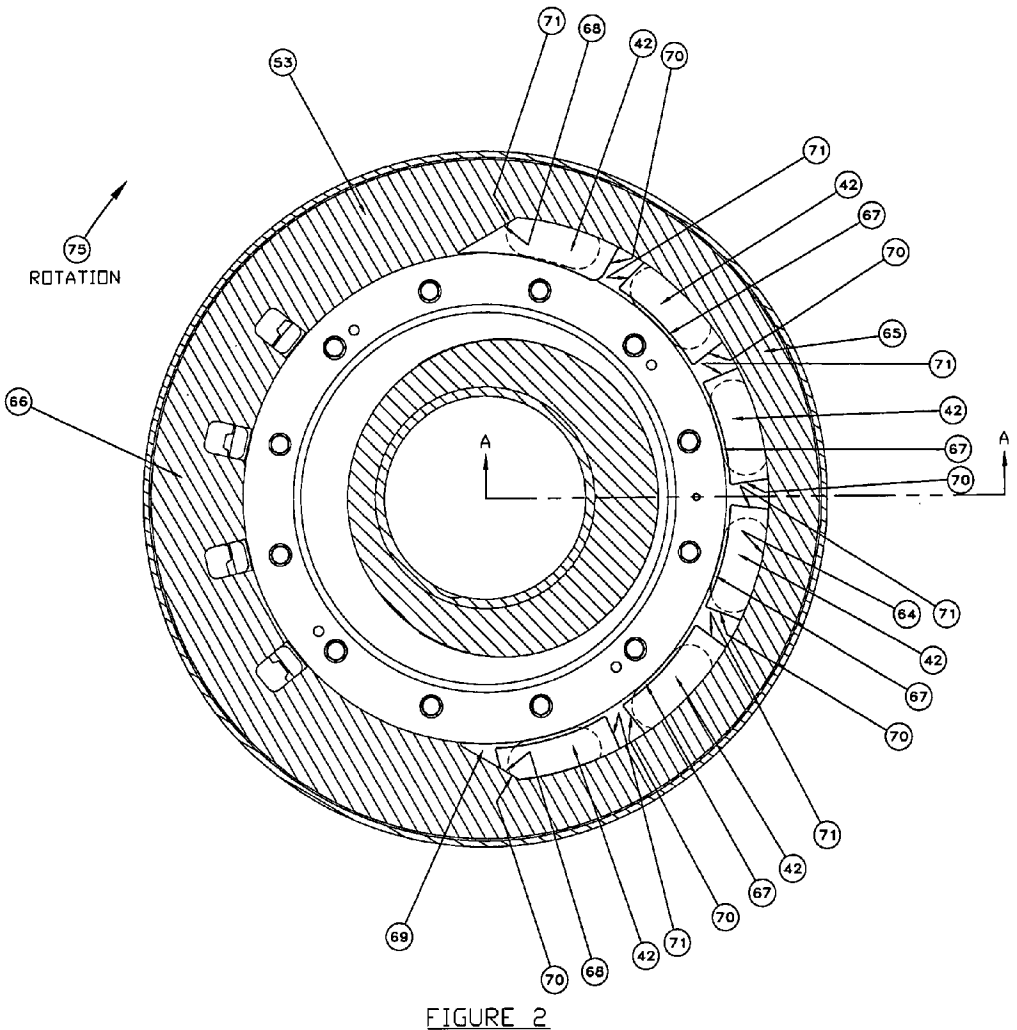
FIG. 2 is an overhead cut away view, partially in relief, of a cone crusher counterweight showing the preferred embodiment of the invention.

FIG. 2 is an overhead cut away view of the counterweight 53 showing the locations of oil deflection plates 42 in the preferred embodiment. The design of the counterweight 53 results in the counterweight 53 having a heavy side 66 and a light side 65. To assist in creating this weight difference, the light side 65 is thinner and contains holes or "kidneys" 67, generally shown in relief in the figure. The differing thicknesses in the sides also result in two "transition ledges" 68 (which, in the depicted embodiment, are actually positioned directly underneath an end 70 and 71, respectively, of a transition ledge 42) where the thicker, heavy side 66 transitions into the thinner, light side 65.

In the preferred embodiment of the invention, the oil deflection plates 42 are attached to the inside wall 64 of the upper portion of the light side of counterweight 53 and substantially cover the kidneys 67 and the transition ledges 68. The oil deflection plates 42 that cover the kidneys 67 each have ends 70 and 71. End 70, being the "leading" end of the oil deflection plate based on the direction of rotation 75 of the counterweight, is attached to the counterweight 53 higher on the inside wall 64 than the "trailing" end 71 to form a slight angle from the horizontal axis opening in the direction of rotation 75. This slight angle creates a larger surface area redirecting the lubricating oil downward. The invention thereby provides a cone crusher which has significantly less lubrication oil loss.

Figure 3:
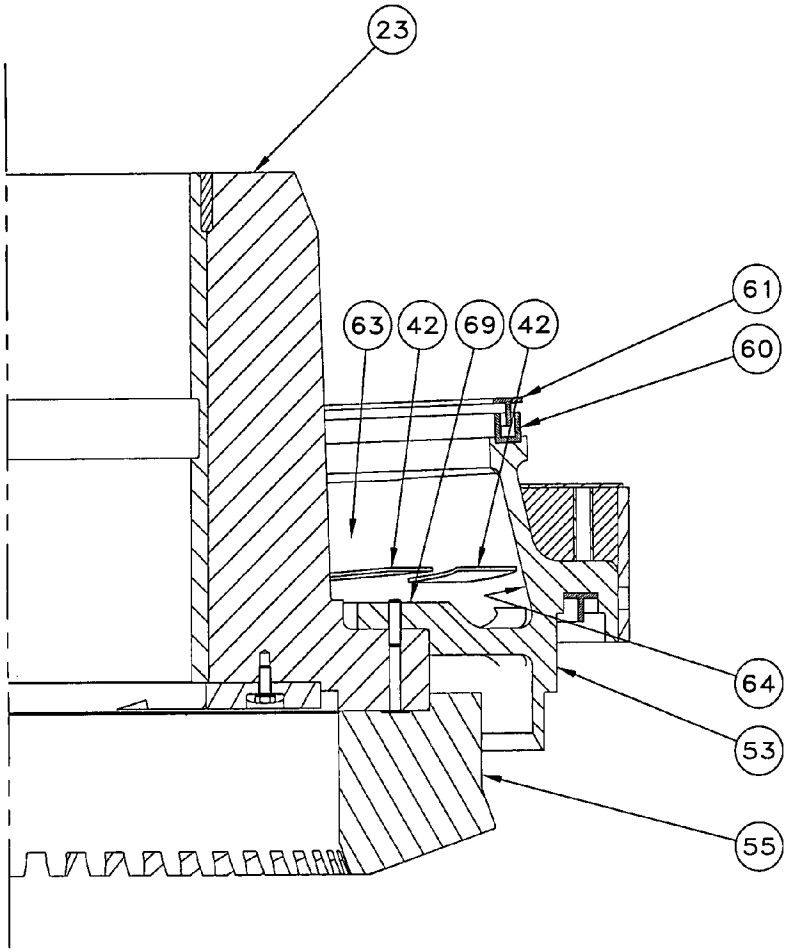
FIG. 3 is a cross-sectional view of a counterweight and eccentric of a cone crusher embodying the present invention as viewed in the direction of the cut shown by arrows A-A of FIG. 2.

FIG. 3 is a cross-sectional view of a portion of a crusher according to the invention as shown from the view A-A in FIG. 2 and showing the horizontal floor 69 extending from the lower portion of the counterweight 53 of the cone crusher that is connected to the eccentric assembly 23 and gear 55. Lubricating oil (not shown) is present in the cavity 63. During operation, lubricating oil travels outward toward and hits the inside wall 64 of the counterweight 53. Upon hitting the inside wall 64, a significant amount of the lubricating oil is redirected upward and, in prior art crusher designs, passes through the seals 60 and 61 and exits the cone crusher 10.

Oil deflection plates 42 extend at an angle from the inside wall 64 of the counterweight 53 toward the cavity 63 and are positioned to have their underside (i.e., the side closest to the floor of the counterweight) redirect the lubrication oil downward rather than upward toward the seals 60 and 61. The depicted view toward the leading edge of the plate, which is opposite the edge that is attached or otherwise abuts the wall of the counterweight.

The oil deflection plates covering the kidneys are generally located between 0.5" to 4" above the kidneys and have a slight angle, preferably from about 2° to about 15° from horizontal that opens in the same direction as the direction of the counterweight rotation. This angle is realized by positioning one end of the oil deflection plate higher than its opposite end on the wall of the counterweight. That is, the oil deflection plate is not exactly horizontally on the wall of the counterweight. This feature results in the redirection of the lubrication oil downward and away from the seals and head assembly. In addition, as lubricant is utilized by the eccentric along its entire length, although benefits can be achieved by having an oil deflection plate attached to and extending out from the eccentric in the direction of the upper portion of the counterweight and thereby overhanging the horizontal floor, it is preferred that the oil deflection plate not be positioned where it can impede any lubricant from traveling down the length of the eccentric. Each oil deflection plate may optionally overlap an adjacent oil deflection plate by between about 0.25" to about 1.5".

The oil deflection plates will have an elongated arc-like shape to correspond to the generally cross sectional profile of the counterweight. As such they may have a substantially rectangular configuration, although they can have other shapes configured to redirect oil from exiting the crusher. The size of the oil deflection plates will depend on a number of factors, such as the size of the crusher and the location of the kidneys that the plates are designed to cover relative to the counterweight and eccentric. Generally, baffles designed to cover kidneys will typically extend out to a distance of no more than about 40% of the total distance from inside wall 64 of the counterweight to the eccentric measured as a straight line.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed:

1. A cone crusher comprising:

a frame;

a bowl supported on the frame;

a crusher head for eccentric rotation about an axis, the crusher head being positioned in spaced relation to the bowl;

a generally cylindrical eccentric assembly supporting the crusher head and having a center of gravity off the axis of eccentric rotation;

a counterweight encircling the eccentric assembly and rotating in unison with the eccentric assembly, the counterweight having a heavy side and a light side, said light side having an upper portion, a lower portion, and a horizontal floor extending from said lower portion in the direction of the eccentric assembly; and at least one oil deflection plate extending from said upper portion of said counterweight and overhanging said horizontal floor and positioned to deflect oil toward said horizontal floor, said oil deflection plate having two ends, a front edge and a rear edge that abuts the counterweight.

2. The cone crusher as in claim 1 wherein there is at least one kidney that extends at least partially through said horizontal floor.

3. The cone crusher as in claim 2 wherein at least one oil deflection plate substantially overhangs said at least one kidney.

4. The cone crusher as in claim 1 wherein the counterweight further has at least one transitional ledge formed where said heavy side meets said light side.

5. The cone crusher as in claim 4 wherein there is at least one oil deflection plate that overhangs said horizontal floor at said transitional ledge.

6. The cone crusher as in claim 3 wherein one end of the oil deflection plate abuts the counterweight at a higher position then the other end.

7. The cone crusher as in claim 6 wherein the oil deflection plate is positioned at an angle that ranges from about 2° to about 15° from the horizontal, said angle opening in the same direction as the direction of the counterweight rotation.

8. The cone crusher in claim 3 wherein there are a plurality of oil deflection plates overhanging the at least one kidney, with at least two of said oil deflection plates overlapping each other.

9. The cone crusher in claim 8 wherein the overlapping deflection plates overlaps each other by between about 0.25" to about 1.5".

10. The cone crusher in claim 8 where said oil deflection plates are attached by being bolted or welded to said light side.

11. The cone crusher in claim 8 where said oil deflection plates are cast as an integral part of said light side.

12. The cone crusher in claim 8 wherein further there is at least one oil deflection plate that extends from said eccentric assembly, overhangs said horizontal floor and is positioned to deflect oil toward said horizontal floor.

13. A cone crusher comprising:

a frame;

a bowl supported on the frame;

a crusher head for eccentric rotation about an axis, the crusher head being positioned in spaced relation to the bowl;

an eccentric assembly supporting the crusher head and having a center of gravity off the axis of eccentric rotation;

a counterweight attached to the eccentric assembly, the counterweight having a heavy side distal to the eccentric assembly and a light side proximate to the eccentric assembly, said light side having an upper portion and a lower portion, and a horizontal floor extending from said lower portion in the direction of the eccentric assembly; and at least one oil deflection plate that extends from said eccentric assembly, overhangs said horizontal floor and is positioned to deflect oil toward said horizontal floor.

* * * * *